United States Patent [19]

Benini

[11] 3,980,567

[45] Sept. 14, 1976

[54] OPTICAL CIGARETTE END INSPECTION METHOD AND DEVICE

[75] Inventor: Fernando Benini, Bologna, Italy

[73] Assignee: AMF Incorporated, White Plains, N.Y.

[22] Filed: Mar. 18, 1975

[21] Appl. No.: 559,615

[30] Foreign Application Priority Data

Mar. 22, 1974 Italy ..... 12646/74

[52] U.S. Cl. ..... 250/223 R; 209/111.7 R; 250/227

[51] Int. Cl.[2] ..... G01D 21/04

[58] Field of Search ..... 250/223, 227, 209; 209/111.7, 111.5; 131/21 R

[56] References Cited

UNITED STATES PATENTS

| | | | |
|---|---|---|---|
| 3,334,240 | 8/1967 | Black | 250/223 R |
| 3,557,374 | 1/1971 | Schmermund | 131/21 R |
| 3,557,375 | 1/1971 | Schmermund | 131/21 R |
| 3,709,612 | 1/1973 | Clemens | 250/227 |
| 3,729,636 | 4/1973 | Merker | 209/111.7 |
| 3,812,349 | 5/1974 | Gugliotta et al. | 250/223 R |
| 3,818,223 | 6/1974 | Gibson et al. | 250/223 R |

*Primary Examiner*—David C. Nelms

*Attorney, Agent, or Firm*—George W. Price; Charles J. Worth

[57] ABSTRACT

A method and apparatus for inspecting the ends of cigarettes by use of a spaced pair of optical fiber probes illuminating the ends of a cigarette and receiving light therefrom, and electronic circuit means converting the reflected light into representative signals which when processed and compared to a threshold signal provides a reject signal when at least one end of a cigarette is unacceptable.

9 Claims, 2 Drawing Figures

OPTICAL CIGARETTE END INSPECTION METHOD AND DEVICE

Figure 1:
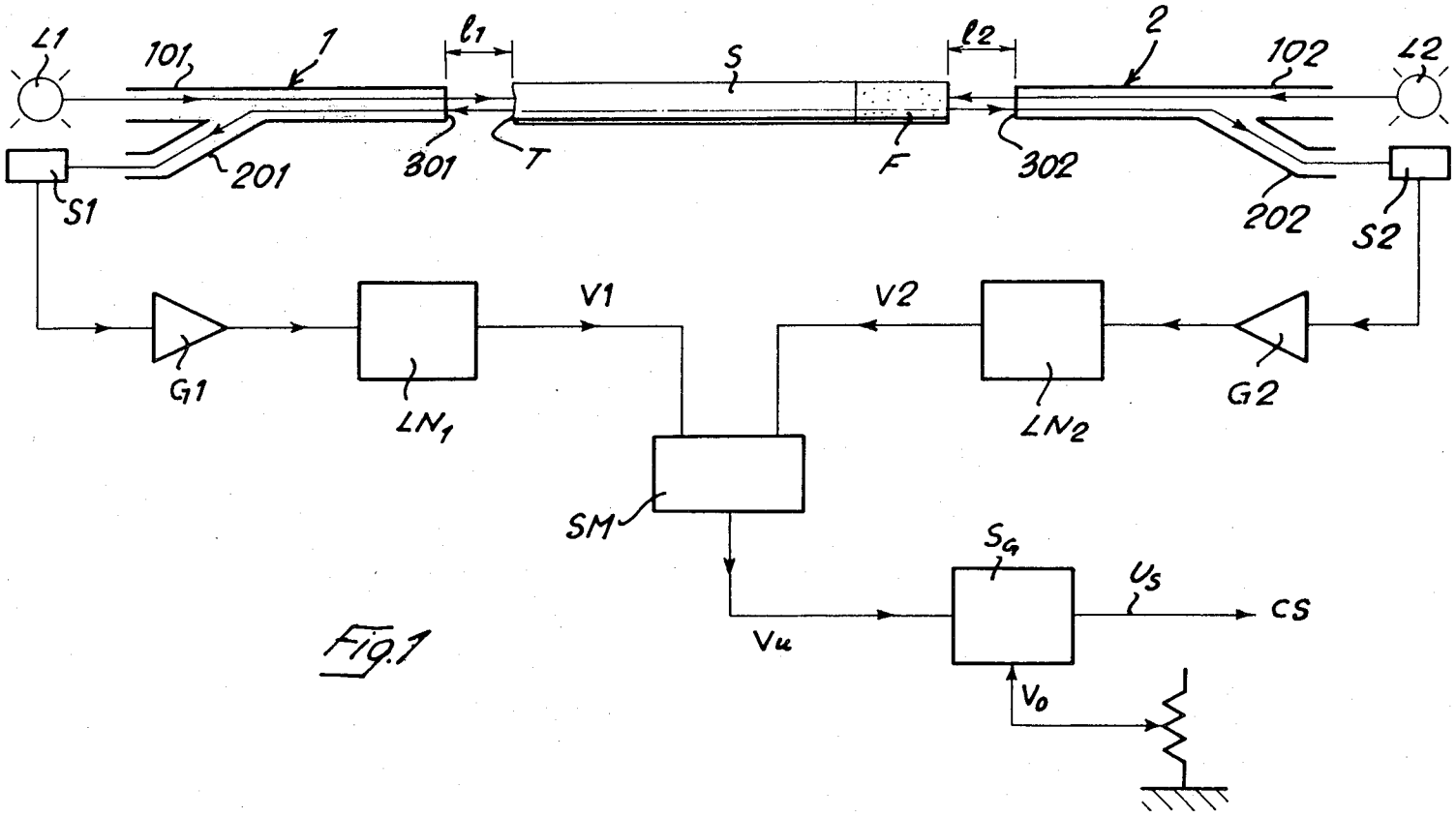

The optical cigarette end inspection is based, as known, on the fact that the light reflected by a cigarette end depends on the cut tobacco firmness at the cigarette end being inspected; that is, on the so-called superficial cut tobacco "density". Consequently, by sending a constant light beam against the cigarette end surface and by picking up the corresponding reflected light, the intensity of the latter will give an optical indication of the degree of density, from which, when appropriately processed, can be derived a signal for the rejection of the cigarettes which prove to be defective for the lack of desired end firmness.

In particular, certain known optical inspection devices use groups of optical fibres called probes to convey the light beam to the cigarette end being tested and to pick up the light reflected by this end. In these groups, the afferent and deferent optical fibres can be intermingled, in a casual manner or, according to preestablished configurations. The cigarette ends to be inspected are caused to sequentially and rythmically move past the probe head, at a distance which should be maintained constant, so as not to misrepresent the results of the inspection which is by itself very delicate.

On the other hand, this movement of cigarettes which is also very rapid is accomplished by making a row of cigarettes, arranged in an orderly manner on a suitable conveyor, pass before the probe head. The conveyer is usually a fluted drum in whose flutes the single cigarettes of the row are generally held by suction. The substantially perfect alignment of such a row of cigarettes which is the requisite for the constant distance between the probe head and the cigarette ends to be tested involves, however, the necessity of having to overcome considerable construction difficulties. This invention is particularly aimed at eliminating such construction difficulties.

Therefore, an object of the present invention is to provide an optical cigarette end inspection method in which the alignment of the row of cigarettes to be tested becomes a substantially insignificant factor as far as the accuracy of the test and the consequent high dependability of the results are concerned.

Another object of the present invention is to provide an optical reject signal generator to reject from a moving row the cigarettes with insufficiently filled ends. Generally, according to the present invention, both ends of a cigarette being tested are simultaneously scanned with guided light beams, one of these ends being generally the filter end. The light reflected by these ends are directly or indirectly processed in order to discriminate between reflection intensity variations due to casual axial cigarette displacement in the row from such variations due to filling defects of the cigarette end or ends. More particularly, in a device which practically realizes this method, each cigarette of the row to be tested is caused to pass transversely between the opposed fixed outputs of two optical probes, which simultaneously illuminate both ends of the cigarette being tested, and the light reflected by these ends, still guided through the optical probes are appropriately converted into electrical signals the sum of which is subsequently compared with a sample or threshold signal, such as to compensate the above reflection intensity variations in opposite directions. By so doing a certain axial cigarette displacement tolerance is possible, without altering the reflection intensity equidirection component or components, which constitute the measurement of the superficial cut tobacco density in the cigarette end or ends being examined.

Still more specifically, when the test is conducted on a filter tip cigarette, the measurement of the light reflected by the filter end is processed in terms of distance of the cigarette end from the output end of the associated probe, and is, consequently, compared by integration, with the corresponding information supplied by the other end.

Naturally, the use of two opposed probes can be adopted also for the simultaneous inspection of the two ends of a plain cigarette. According to a further feature of the invention, at least one of the two optical probes, and particularly, the one facing the cigarette end, if plain cigarettes are to be tested, can be replaced by a plurality of independent pairs of optical probes, with the purpose of scanning by areas the cigarette end, for a more selective inspection. In fact, if only one pair of wide section optical probes is used for testing the cigarette end, a cut tobacco stem protruding in an empty end, would give a false indication of regular cigarette, on account of the great light reflected by the stem.

Although several embodiments of the invention have been illustrated and described in detail, it is to be expressly understood that the invention is not limited thereto. Various changes may also be made in the design and arrangement of the parts without departing from the spirit and scope of the invention as the same will now be understood by those skilled in the art.

Figure 2:
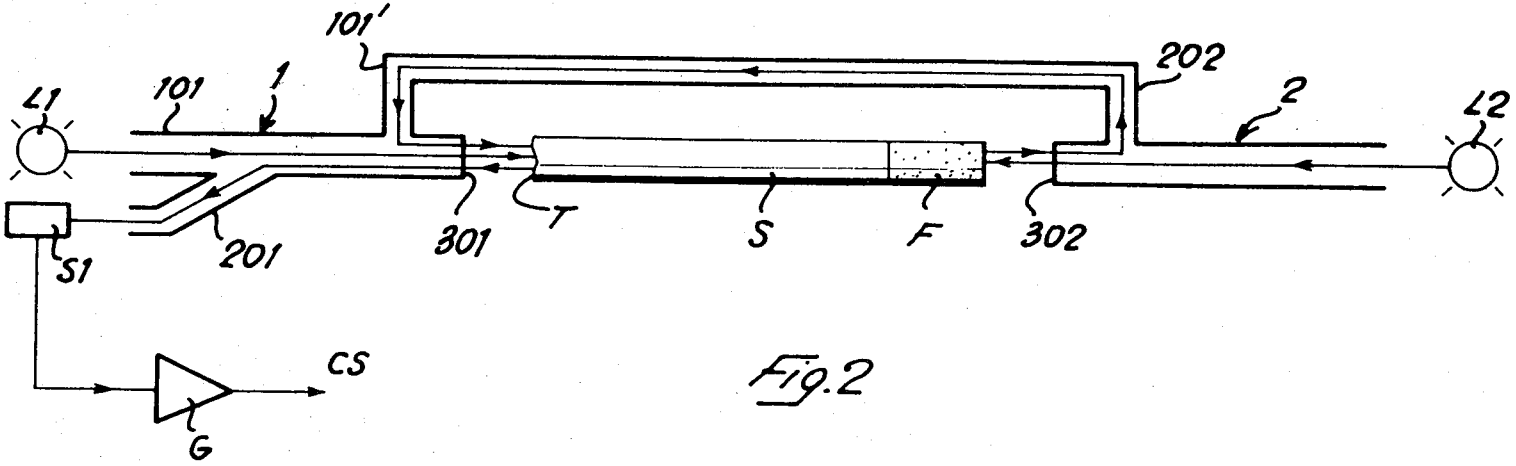

FIG. 1 is a schematic view of an optical cigarette end inspection device made in accordance with the invention, and FIG. 2 is a view similar to FIG. 1 of a modified optical cigarette end inspection device made in accordance with the present invention.

With reference to the drawings and particularly to FIG. 1, the novel inspection device is provided with a pair of optical probes 1 and 2 disposed in spaced face to face alignment each consisting of the known groups of optical fibers. The end or output head 301 of probe 1 faces the end T of a cigarette S and is spaced a distance $1_1$ from it. The corresponding end or head 302 of the probe 2 faces the end of filter F of the same cigarette and is spaced a distance $1_2$ from the filter. A lamp L1 and a photoelectric transducer S1 are provided adjacent the end of the probe 1 opposite from its head 301 while a similar lamp L2 and photoelectric transducer S2 are provided adjacent the end of the probe 2 opposite from its end 302.

The optical fibers of probe 1 separate at the end opposite from the head 301 into two distinct groups 101 which terminates adjacent the lamp L1 and 201 which terminates adjacent the photoelectric transducer S1, while at the end towards the head 301 all of the fibers of groups 101 and 201 are gathered into a single group in which they are uniformly intermingled. Thus, light which is of constant intensity from the lamp L1 is conveyed or transmitted by the group of fibers 101 to the head 301 from where it projects against the end T of cigarette S, and is reflected in part thereby determined by the cigarette end firmness. The reflected light is picked up or received by the group of fibers 201 at the head 301 and transmitted to the photoelectric transducer S1.

The optical fibers of probe 2 separate at the end opposite from the head 302 into two distinct groups 102 which terminates adjacent the lamp L2 and 202 which terminates adjacent the photoelectric transducer S2 while at the end towards the head 302 all of the fibers of groups 102 and 202 are gathered into a single group in which they are uniformly intermingled. Thus, light which is of constant intensity from the lamp L2 is conveyed or transmitted by the group of fibers 102 to the head 302 from where it projects against the filter end F of the cigarette S and is reflected in part thereby determined by the filter end surface. The reflected light is picked up or received by the group of fibers 202 at the head 302 and transmitted to the photoelectric transducer S2.

The intensities of the light reflected by end T of cigarette S and by filter end F of the same cigarette are, among other things, nonlinear functions of distances $\mathbf{1}_1$ and $\mathbf{1}_2$ between the outlets or heads 301 and 302 of the groups of optical fibers of probes 1 and 2 and the respective reflecting surfaces of the ends of cigarette S. Obviously, this intensity depends also on the nature of the reflecting surface. Each transducer S1 and S2 supplies an electrical output signal whose amplitude is a nonlinear function of the intensity of the light reflected and conveyed to the sensing unit through the respective group of fibers 201 and/or 202.

These output signals from sensing units S1 and S2 are applied to the inputs of respective amplifiers G1 and G2 whose outputs are, in turn, applied to the inputs of respective linearizing networks (networks each having a nonlinear transfer function) LN1 and LN2. The networks LN1 and LN2 supply output voltages V1 and V2, which are respectively proportional to lengths $l_1$ and $l_2$, so that such signals V1 and V2 are representative of the said lengths, that is, they constitute the measure of these lengths. Voltages V1 and V2 are applied to the inputs of a summing circuit SM, whose output supplies, therefore, a signal Vu which represents a measure of the sum of lengths $l_1 + \mathbf{1}_2$.

Since the optical probes 1 and 2 are mounted stationary and, consequently, the distance between their heads 301, 302 is constant, and since the length of the cigarette S to be tested is also constant, sum $l_1 + \mathbf{1}_2$ will be constant, independent of the axial displacement of the cigarette S, that is, of the axial misalignment of a cigarette S in relation to the theoretic arrangement according to which they are guided between the probes 1 and 2.

Consequently, for all the cigarettes S with no end defects (such as insufficient degree of firmness, missing filter, etc.) the output signal Vu from the summing circuit SM will not change and, since in these conditions it contains only the information relating to the sum $l_1 + l_2$, it supplies also an indirect measure of the length of the cigarettes S. Signal Vu can, therefore, be compared, in a threshold circuit $S_g$, with a sample circuit Vo which represents, on the basis of analogous criteria, the length (constant) of cigarettes S being tested.

It is, therefore, evident that, for all the regular cigarettes, such comparison will result in voltages Vu and Vo of equal value and no signal $U_S$ will be issued by output $U_S$ of the threshold circuit $S_G$.

On the contrary, if a cigarette S shows some irregularity at its ends, signal Vu, containing also the information relating to such irregularity, will deviate from the comparison of parity with the sample signal Vo, thus causing the emission at the output $U_S$ of the threshold circuit $S_G$ of a reject signal CS which will cause in due time the rejection of the cigarette S which has given rise to it.

If, for a finer cigarette end inspection, it is desired to use a plurality of pairs of probes (1 and 2) each destined to scan part of a cigarette end, it is evident that a transducer will have to be associated to each probe.

In this case, threshold $S_G$ compares the various measures of the cigarette length ($Vu_1$, $Vu_2$, $Vu_3$..) made by the probes, with the sample signal Vo, and emits the reject signal even if only one of these measures is lower than Vo. Considering that end inspection is made on quickly moving cigarettes, the electronic reject inspection circuit will also include a "strobe" section for the determination of the exact moment in which each test must be made.

It is understood that the invention is not limited to the embodiment which has been illustrated in FIG. 1 and described above as an example, but can be widely changed, mainly constructively, without departing from the wider limits of the spirit of the invention.

Thus, for instance, FIG. 2 illustrates another embodiment in which this principle is practically achieved.

As was previously discussed, the invention is substantially based on the observation that if both ends of a cigarette are simultaneously illuminated and if information is obtained on the status of one or both ends, from the light reflected by these ends, the intensity of the light reflected by each end will have, in general, a component which depends on the nature and on the condition of the scanned end; and another component which depends on the distance between the cigarette end and the associated probe. This latter component, in view of its depending on the axial position of the cigarette being tested between the ends of the optical probes presents opposite variations. In other words, to an increase of the light reflected by a cigarette end corresponds a decrease of the light reflected by the other cigarette end and viceversa.

In the embodiment described with reference to FIG. 1, these opposite variations are used in a logic circuit to discriminate the information relating to the axial cigarette displacement from that relating to the conditions of the end or ends of the cigarette being tested.

In the embodiment of FIG. 2, particularly suitable for filter tip cigarettes, the same light variations in opposite directions are self-compensated between each other by means of a peculiar optical retroaction circuit, whose realization is possible because of the particular properties of the groups of optical fibers.

In this embodiment, as in that of FIG. 1, probe 1 associated to transducer S1 and to amplifier G (which now directly emits reject signals CS) is again disposed on the side of end T of cigarette S being tested. The group of fibers 101 receives the light from lamp L1, while group 201 conveys to the transducer S1 the light reflected by end T. On the side of filter F the probe 2 still conveys light from lamp L2 against the filter end, while the return group of fibers 202, which picks up the light reflected by the filter end conveys the reflected light to the other end of the cigarette S and through input 101' to probe 1, so that it is added to the reflected light originating from lamp L1.

The purpose and the effect of the foregoing are evident. An axial misalignment of the cigarette S causing the end T to be moved away from the head 301 of probe 1 is compensated by an increase of the luminous intensity through the fiber group 202 and input 101'. An axial misalignment of the cigarette S in the opposite direction, will increase the luminous intensity of the reflected light from end T and the intensity of the light reflected by the filter end F decreases accordantly.

Thus, the luminous intensity picked up by the group of fibers 201 and conveyed to transducer S1, in effect depends only on the condition of end T and not on the distance of this end from the head 301 of the probe 1.

In this case, no linearity consideration arise between the amount of the cigarette misalignment and the intensity of the light reflected by the end T and by filter F, since this intensity, with other factors in the same conditions, changes in opposite directions, but with the same law, whereby the compensation through fibers 202 input 101' is automatically assured.

At most, by using a particularly intense source L2, and, for instance, a coherent light source, L1 could be omitted. In this case, the lack of filter F will automatically cause the cigarette rejection due to the absence of reflected light, even if cigarette end T would be regular.

Although several embodiments of the invention have been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. A method for optical end inspection of cigarettes sequentially arranged in a row, comprising the steps of providing a pair of axially aligned optical probes fixedly spaced axially from one another; passing a row of cigarettes to be tested laterally one after the other between, and substantially through the axis of, the pair of probes; providing light beams which are guided by said pair of probes for illuminating both ends of each cigarette being tested substantially at the same time by guided light beams; receiving reflected light from the ends of the cigarette being tested by the probes; converting the light reflected by both cigarette ends to generate a single reject signal when the total reflected light differs from a predetermined threshold, thereby indicating the existance of faults detectable by light in at least one of the ends of each cigarette tested.

2. The method according to claim 1, in which the intensities of light reflected by the cigarette ends are processed to automatically compensate for the influence of axial misalignment.

3. Method according to claim 2 in which the lights reflected by the cigarette ends are jointly processed in relation to their intensities to discriminate between reflected light components resulting from axial misalignment and optically detectable faults.

4. A device for the optical inspection of the ends of cigarettes caused to move in an orderly manner sequentially arranged in a row through a test point, comprising a pair of axially spaced and aligned probe means of optical fibers with each of said probe means operatively associated with a light source and arranged at the test point to convey light simultaneously against both ends of a cigarette at a moment a cigarette is passing through the test point between, and substantially through the axis of, said probe means; and to pick up and guide separately reflected light from each end of said cigarette; electronic processing means responsive to reflected light to generate a single reject signal in response to the existance of faults detectable by light reflection on at least one end of the cigarette tested.

5. The device according to claim 4, and said electronic processing means comprising a pair of transducers each responsive to a different beam of reflected light and generating an electrical analog signal whose amplitude represents the intensity of said beam of reflected light on the basis of a non-linear function, an amplifying circuit operatively associated with each transducer to amplify the signal supplied by the transducer and a linearizing circuit processing each said amplified signal to provide linearity signals indicative of the distance between each end of the cigarette being tested and the adjacent probe means.

6. The device according to claim 5, and a summing circuit receiving said linearized signals and providing an output signal which contains a component representing the distance between the ends of the cigarette being tested and the probes, and a component representing information on the integrity of the ends of the cigarette being tested.

7. The device according to claim 6 and a threshold circuit receiving the output signal from said summing circuit and comparing such signal to a threshold signal representing the distance between the ends with desired integrity of a cigarette being tested and said probes, and said threshold circuit providing a reject signal each time a difference occurs between the output signal from said summing means the threshold signal relating to the condition of integrity of the ends of the cigarette being tested.

8. The device according to claim 7, and each of said probe means having a head end and two groups of optical fibers of which one group conveys light from a source and the other receives reflected light, and said group of fibers of one of said probe means receiving reflected light conveying the reflected light to the head end of the other of the said probe means.

9. The device according to claim 8, in which the fibers of each of said probe means are uniformly intermingled in the head end thereof.

* * * * *